United States Patent [19]

Cook

[11] 4,259,028

[45] Mar. 31, 1981

[54] WATER AND DEBRIS IMPERMEABLE TRENCH BOX PANEL

[75] Inventor: John B. Cook, East Lansing, Mich.

[73] Assignee: Efficiency Production, Inc., Okemos, Mich.

[21] Appl. No.: 896,745

[22] Filed: Apr. 17, 1978

[51] Int. Cl.[3] ..... E21D 5/00

[52] U.S. Cl. ..... 405/282; 52/309.9; 52/309.11; 52/309.14; 52/785; 405/272; 428/71; 428/75; 428/192; 428/313; 428/322; 428/340; 156/79

[58] Field of Search ..... 428/71, 310, 322, 167, 428/119, 192, 340, 313, 60, 75; 156/77–79; 52/785, 309.4, 309.7, 309.9, 309.11, 309.14, 309.16; 405/150, 151, 282, 283, 284, 276, 280, 272

[56] References Cited

U.S. PATENT DOCUMENTS

| | | | |
|---|---|---|---|
| 3,593,528 | 7/1971 | Pavese | 405/282 |
| 3,641,724 | 2/1972 | Palmer | 156/78 |
| 3,783,082 | 1/1974 | Almog | 428/322 |
| 3,785,913 | 1/1974 | Hallamore | 156/78 |
| 3,969,852 | 7/1976 | Krings | 52/309.11 |
| 3,992,887 | 11/1976 | Fisher | 405/283 |
| 4,048,778 | 9/1977 | Krings | 428/119 |
| 4,057,944 | 11/1977 | Wyatt, Jr. | 52/309.11 |
| 4,116,893 | 9/1978 | Flanagan | 428/31 |

*Primary Examiner*—Paul J. Thibodeau

*Attorney, Agent, or Firm*—Miller, Morriss and Pappas

[57] ABSTRACT

A trench box panel with an especially lightweight foamed filler located between the inner and outer panel surfaces in a trench box panel and between structural, vertical and horizontal elements in prevention of the intrusion of water, mud and grime. The impermeable panels thus produced are more convenient to use, require less inspection in production against leakage and do not become so heavy as to be almost impossible to move and maneuver during usage. The procedures of filling the panels with lightweight unfilled foam is by use of blocks, foaming in situ, and fill foaming.

8 Claims, 10 Drawing Figures

WATER AND DEBRIS IMPERMEABLE TRENCH BOX PANEL

BACKGROUND OF THE INVENTION

The present invention is directed to a water and debris impermeable trench box panel and to the procedures for fabricating such structures. Trench boxes are structures which are dropped into trenches and earth openings in the manner of shoring and comprise plural heavy panels in paired spaced-apart adjacent register and frequently in stacked paired relation. The spaced panels are separated usually by spacer or spreader means in prevention of collapse. The object of the trench boxes is to hold out mud, water and excavated debris so that work can proceed within the boxes without endangering lives of workers in the trench or ditch. The boxes are usually assembled at the use site. By means of mechanical shovels or derricks the boxes are maneuvered into an earth opening and, as digging proceeds, the trench box is towed, nudged or urged into and along the newly prepared opening and the old opening is closed behind it over work product such as pipe or cable that has been coupled and placed in the trench by workmen. The boxes considered herein are usually made of steel and comprise at least a pair of strong panels. The panels are usually framed around the perimeter and the lower edge is usually beveled or chisel-shaped to easily penetrate and seal off the lower working face. Bearing the total weight of the panel, the chisel edge digs into the trench bottom. For the most part the outer or perimeter framing comprises a plurality of structural shapes as, for example, tubes. The perimeter frame is connected to a honeycomb interior skeleton defined by plural vertical support elements and horizontal support elements. This internal support structure, together with the perimeter frame including the chisel edge, provides a core support for inner and outer panel plates that are brought into substantially parallel register thereagainst. The plates form inner and outer skins. These skins are usually steel or aluminum sheet and the structural elements against which they are contacted are usually and correspondingly steel or aluminum and the manner of attachment is usually by welding using plug or projection welds at intervals through the skins and against the interfacing internal structural surfaces. As will be appreciated, stresses are carried through the perimeter frame and the internal skeleton reinforcing and being reinforced in turn by the attachment to the inner and outer skins. The perimeter is usually secured as by fillet welds at perimeter interphases of skins to frame and bevel or chisel edges. Thus, the trench box panels are closed as by welding but unless the most time-consuming effort is involved there are usually openings through which air, water and debris can permeate. If not present at manufacture the holes appear shortly after the trench box panels are flexed in service. These openings are exaggerated by the traumatic service that the panels receive during excavation, tamping and dragging. These stresses open the panels sufficiently so that even the soundest panels, when put into service, are unsealed and water and mud or debris enter the box and into the cavities of the panels and in time the panels of the box become useless or disabled because of the great weight of the water and accumulated mud. Not unusually the mud itself prevents draining the panel and if the panel is left in the trench, the problem is even more exaggerated.

To solve this problem the present invention fills the internal honeycomb openings or cavities between verticals and horizontal structural elements with closed cell foamed plastic material. The preferred material is lightweight foamed styrene in as close a fit as possible. The preferred technique is to use a foamed in situ procedure. This is achieved after completion of assembly and by applying foaming nozzles to one or more prepared openings through the skin and pumping the plastic and foaming agent formulation into the cavities between skins. The most economic procedure at this time, however, is the sculpting or cutting of foam blocks and the fitting of these blocks into the void spaces or cavities between skins with one skin welded in place. Then the other skin closes the sandwich and is welded to the structurals and frame parts. A combination technique is to close one side with one skin, pour foam composition into the cavities while the panel is lying flat and then cure in situ and thereafter close the panel by attachment of the inner skin. Panels of excellent quality result from any of these procedures and the expense of leak inspection is avoided and field damage to the panels is less likely to result in mud, water and debris intrusion with consequent longer life for the panels.

IN THE PRIOR ART

The closest known prior art is found in the work of Josef Krings of Germany and which finds expression in the two U.S. Pat. Nos. 3,969,852 and 4,048,778 asserting earlier priority based on prior German applications which are both directed to the use of a reinforced rigid foam to be used in shoring panels and in which the structural elements are all gapped periodically as by notching to allow foam flow. The reinforcing material contemplated by the work of Krings is steel as, for example, from steel rope or cable. Accordingly, the disclosures of the prior art are seen as expressing a structural reinforcing or strengthening concept as contrasted with the rendering of the panels relatively impervious.

OBJECTS

Accordingly, the principal object of the present invention is to offer a panel which is impermeable to the intrusion of mud, water and debris so that the panels retain a relatively constant weight and where the impermeable material is relatively weightless.

Another object is to offer a panel using a closed cell foam that is relatively inexpensive.

Another object is to offer procedures for preparation of the panels which assure filling of the honeycomb cavities and in which the foam is resistant to destruction. The procedures also contemplate the preparation of panels without weakening the structural members as by the use of notching and the like.

Other objects including simplicity, economy and extended field usage of the boxes or shoring which employ the impermeable panels will be appreciated as the description proceeds.

GENERAL DESCRIPTION

In general the trench box panels of the present invention are prepared in the usual manner by welding together perimeter structural tubing of steel, aluminum or combinations thereof and physically supporting these by structural verticals and horizontals as by welding or other fastening. Gusset reinforcement plates and connector elements are loaded in and fastened in position. Then one skin, usually the outer skin, is welded or fastened in place using seam welding, for example, along the perimeter and plug or projection welding where the skins engage the verticals and horizontals. At that point the panel is presented in a flat manner with the first or outer skin down and with the interior cavities exposed. Closed cell foamed plastic resin material is carefully fitted into the cavities as by placement of blocks of the lightweight material or by filling the cavities with foam generating composition so that the closed cell lightweight mass fills to the surface defined by the perimeter elements and the structural horizontals and verticals. Then the inner skin is applied, welding or otherwise fastening it to the perimeter elements and projection or plug welding it to the honeycomb forming verticals and horizontals. This produces an excellent quality water impermeable trench box panel useful in trench box structures.

Another procedure, more expensive in small lot production, is to provide openings through the skins and by insertion of foaming nozzles inject foam formulations into the cavity and core portion of the panels with curing in situ. In such procedures openings between cavities are desirable to minimize the number of nozzle openings required and so that the foam material can freely penetrate adjacent compartments. The resultant panel, in use, remains light in weight over prolonged use which use even damages, gouges or penetrates the skin or box panel structures. Despite severe treatment, the inner material remains intact and operative in sealing out dirt, mud, water and debris despite minor intrusions. These procedures substantially eliminate the phenomenon in the field of "water logged" boxes.

IN THE DRAWINGS

SPECIFIC DESCRIPTION

Figure 1:
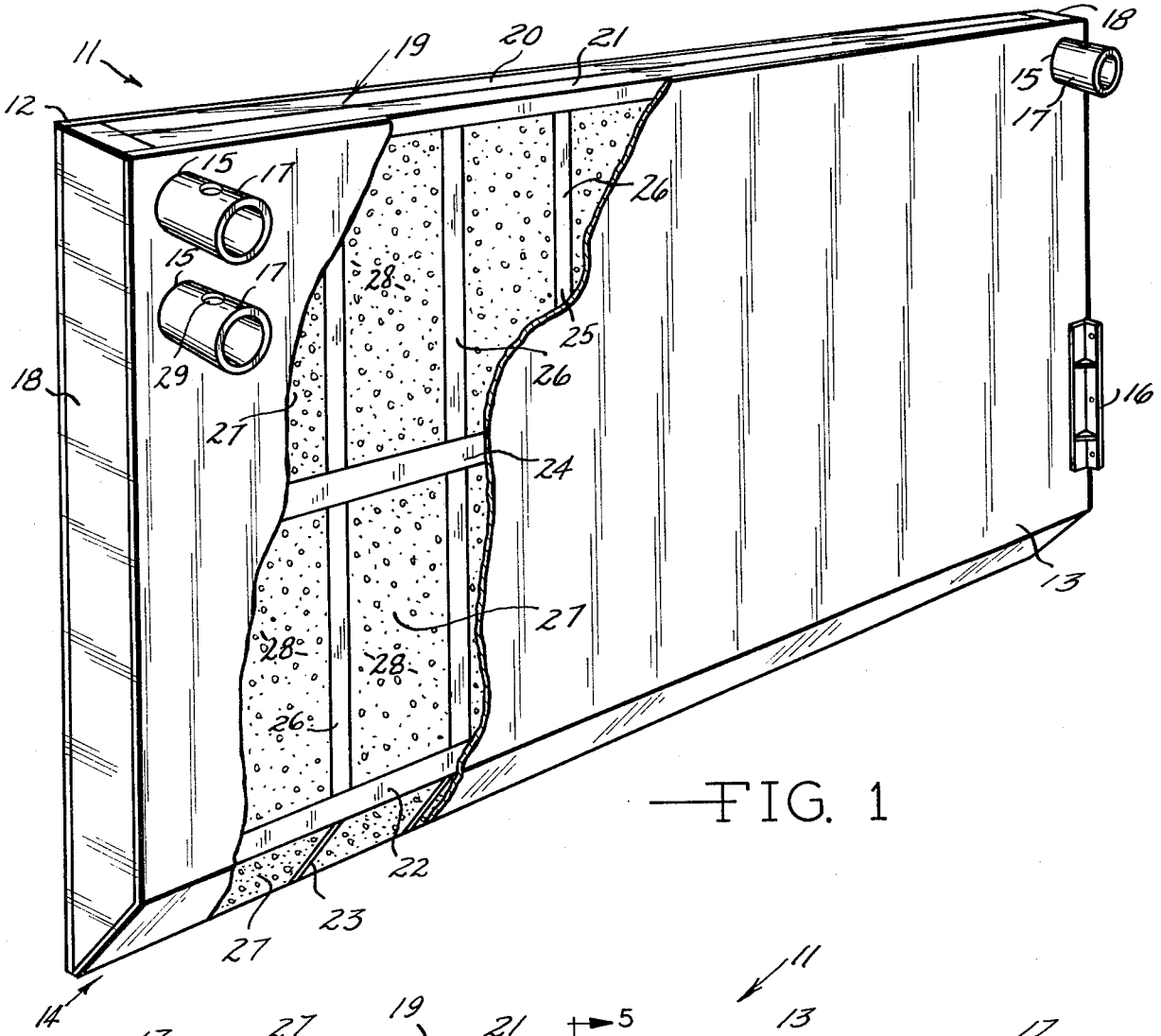
FIG. 1 is a perspective view of a typical trench box panel in accord with the present invention and having one of the skins (interior) cut away to reveal the closed cell water impermeable lightweight filler of the present invention in the cavities of the panel.

Referring to the drawings and with particular attention to the FIG. 1, a trench box panel 11 is shown. The panel 11 in which the invention is illustrated is a two wall panel 11 and the outer wall 12 and inner wall 13 are in spaced-apart parallel register relation except at the chisel or bevel bottom 14 and the connector openings 15 and the spacer bracket 16 which appear on or through the inner skin 13. In the panels 11 the smooth skins present no obstruction for adjacent earth, rock, mud and sand. The openings 15 allow connector cylinders 17 to extend therethrough in stub extensions transverse of the face formed by the skin 13. The spaced-apart relation between the skins 12 and 13 is established by the thickness of the perimeter framing of vertical tube or box section element 18, top rail double box section 19 made up of the two adjacent connected box section tubes 20 and 21, and the box section horizontal element 22 together with the triangular rib plates 23 forming (with the bent out portion of the skin 13) the bevel or chisel bottom 14. An intermediate horizontal structural element (box section) 24 is revealed by the cut-away of the skin 13. As will be seen, the rail 19 and all horizontal structurals are connected to the vertical frame elements 18 and are in spaced-apart retention for stress bearing and transmission by the vertical structural elements 25, such as channels. Thus pounding forces applied to the top rail 19 are transmitted through the structure via the framing and inner skeletal structure and into the bottom 14 which is in contact with a trench bottom or floor in use. The flanges 26 of the channels 25 are flush with the skins 12 and 13 and the skins 12 and 13 are in plane relation with the vertical faces of horizontal elements 22, 24, and rail 19 and with the coplanar surfaces of vertical framing elements 18. In this manner the horizontals and verticals form plural cavities 27 within the panel 11 having generally rectangular configuration. The cavities 27 are substantially completely filled with lightweight closed cell foamed plastic material 28 such as foamed styrene or polystyrene and having a foamed density of about two pounds per cubic foot or less. No reinforcing materials such as steel, fiber, glass or metal fragments are in the foamed material which is generally graded as high bouyancy - low weight or density material.

In most panels 11 the structural elements and skins 12 and 13 are steel and the fastening means is usually by welding. The skins 12 and 13 are seam and fillet welded to the perimeter elements and are welded to the verticals 18–25 and horizontals 19, 22, and 24 by internal projection or plug welding through the skins 12 and 13 and into the broad interphasing skin contacting metal surfaces of the skeletal inner framework. The skins 12 and 13 add stiffness, stability, and strength to the panels 11 and the connectors 17 are fillet welded to the skins 12 and 13 and to their reinforcing elements, as will be seen. Some panels 11 are made from high strength aluminum and these are prepared in substantially the same way with ultimate dimensions and weld intervals established by recommended welding practice. The openings 29 in the collars 17 are for connector pins 35 as will be seen.

Figure 2:
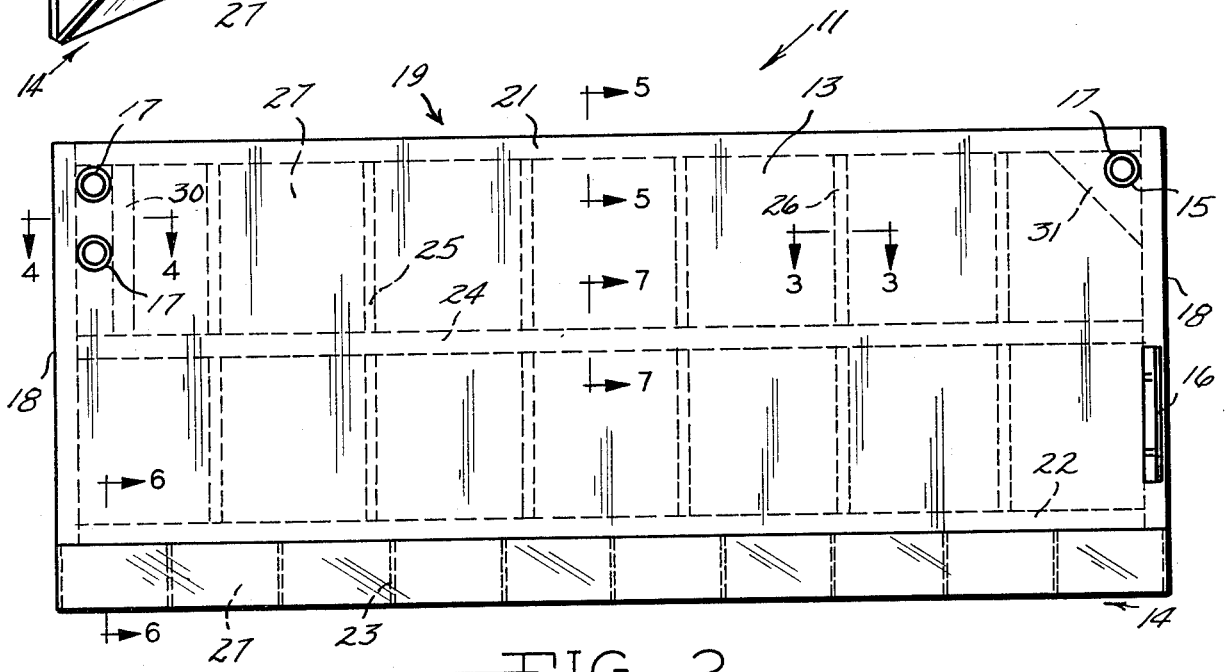
FIG. 2 is a side elevation view of the trench box panel of FIG. 1 and indicating the perimeter framing, the internal grid structure of horizontal and vertical elements and the reinforced bevel or chisel bottom.

In FIG. 2 the structure of FIG. 1 is better understood and the reinforcing vertical reinforcing tube (box section) is seen assisting in strengthening the collars 17 which are connected thereto and to the vertical framing tube 18. The collar 17 at the end of the panel 11 having only one collar 17 is additionally supported by a corner gusset plate 31, not visible in FIG. 1. The cavities 27 are formed in the manner of a honeycomb by the verticals and horizontals of perimeter frame and inner skeleton. In FIG. 2 the fillers 28 cannot be seen. The fillers 28 are closed cell foam in rigid or semi-rigid form and having a density of about two pounds per cubic foot in styrene, polystyrene, or other suitable styrene plastics having closed cell foam, impermeable to water, available from the Dow Chemical Company of Midland, Michigan, U.S.A. under the trade designation, "BB Brand". In situ resin plastic formulations for foaming in the cavities of the panels 11 which produce equivalent physical properties in the cured fillers 28 are satisfactory.

Figure 3:
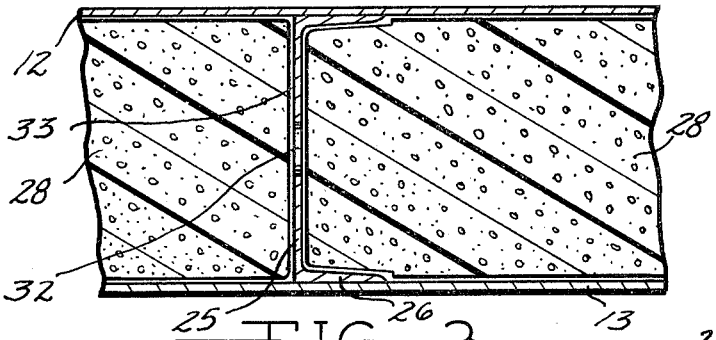
FIG. 3 is a cross section plan view taken on the line 3—3 of the FIG. 2 and through one of the vertical structural elements and indicating the nesting of the closed foam fillers between the flanges thereof.
Figure 4:
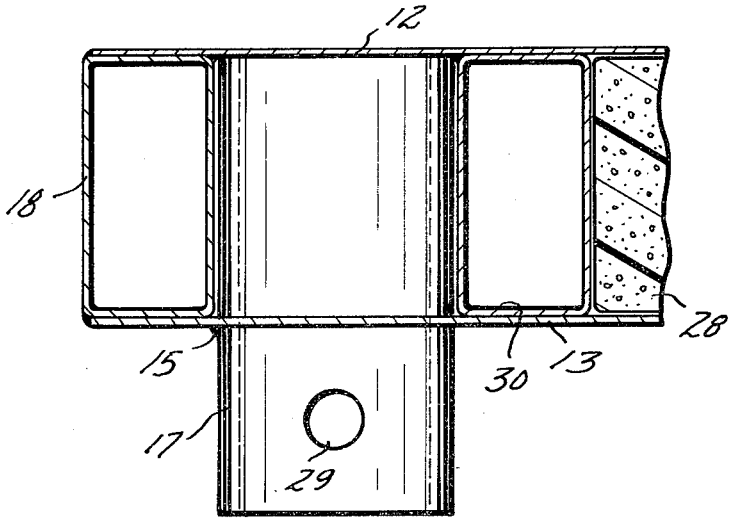
FIG. 4 is a cross section plan view taken on the line 4—4 of FIG. 2 just above a cylindrical connection element and through the tubular box section outer frame and a reinforcement strut.

In FIGS. 3, 4, 5, 6 and 7 details of the fillers 28 between the skins 12 and 13 are shown in the indicated cross-sectioned parts of the panel 11. In FIG. 3 the breather openings 32 in the web 33 of the vertical channels 25 are visible. The breather openings 32 are primarily useful for in situ procedures for location and communication of the fillers 28 to adjacent cavities. In FIG. 4 the vertical outer frame tube 18 and the vertical reinforcing tube strut 30 are seen to flank the collars or connectors 17. The collar 17 is seen to run through the panel 11 to flush contact at the end with the skin 12 and through the hole 15 in the skin 13. The opening 29 in the collar 17 is provided for an assembly pin 35 visible in the FIG. 10. The panel 11 is welded together and the skins 12 and 13 are projection or plug welded to the contacting flanges and surfaces of the interior skeletal structure and fillet welds close the opening 15 on the collar 17.

Figure 7:
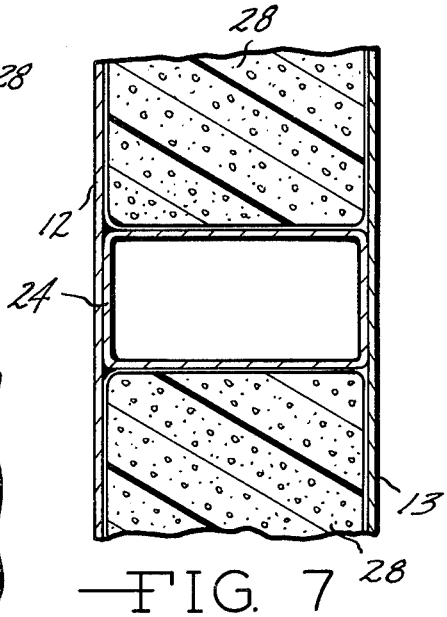
FIG. 7 is a cross section elevation view taken through a box type horizontal structural member on the line 7—7 of FIG. 2 and showing the foamed filler material in place.
Figure 5:
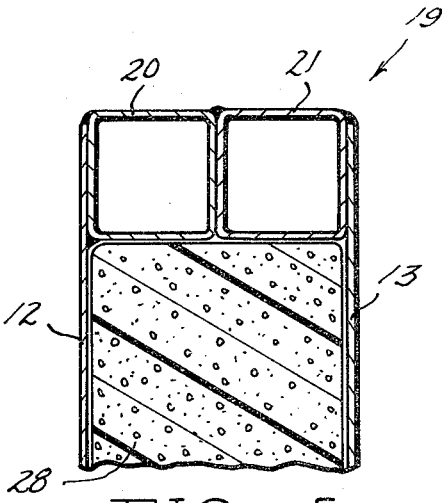
FIG. 5 is a cross section elevation view taken on the line 5—5 of FIG. 2 and through double tube upper frame or rail of the panel with foam filler in place.
Figure 6:
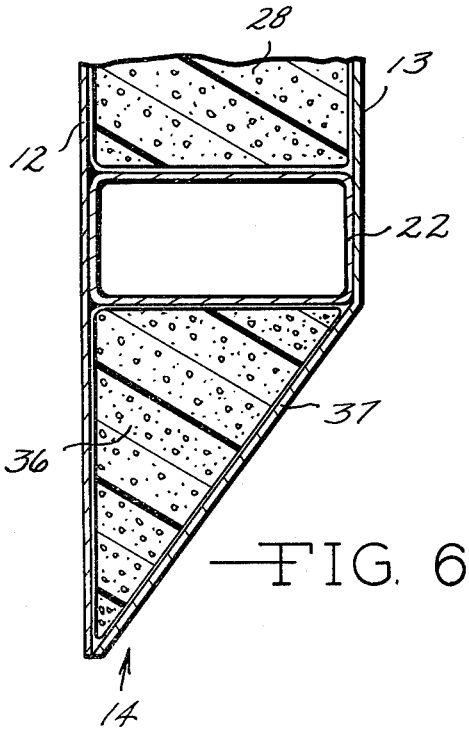
FIG. 6 is a cross section elevation view taken on the line 6—6 of the FIG. 2 and showing the chisel bottom section between triangular rib or gusset elements and through the lower horizontal box stringer indicating the lightweight foam filler in position.

FIG. 5 illustrates the top rail 19 in the preferred embodiment of paired adjacent box section tubes 20 and 21 welded together at their contacts and welded also to the skins 12 and 13 in seam welds in spaced relation through the skins 12 and 13 and into the adjacent surfaces. FIG. 6 illustrates the situation at the bottom 14 of the panel 11 indicating the sharpness of the bevel formed by the connection of skins 12 and 13 by means of the diagonal transverse wall portion 37 running downwardly and outwardly to meet the bottom edge of the skin 12. Into the cavities formed by the bottom 14, the filler 36 assumes the shape of the cavity. The tube or box section horizontal element 22 maintains the thickness spacing of the top rail 19. FIG. 7 elaborates on the similar construction at the horizontal intermediate element 24 between the skins 12 and 13 and the skins 12 and 13 being projection or plug welded to the contacting outer faces of the element 24 as is also the construction in FIG. 6. Fillers 28 are shown.

Figure 8:
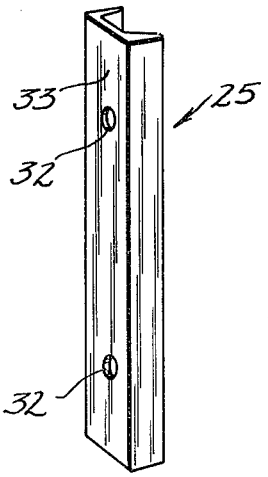
FIG. 8 is a perspective view of one of the channel-shaped vertical structural elements with perforations through the web to allow communication between cavities for foaming in situ.

FIG. 8 best illustrates the vertical channels 25 with the web 33 and flanges 26 establishing the thickness between skins 12 and 13 and to which the skins 12 and 13 are projection or plug welded at spaced intervals. The openings 32 are also revealed.

Figure 9:
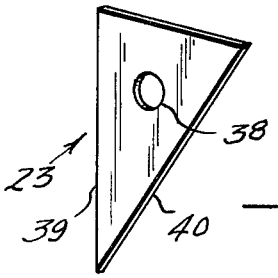
FIG. 9 is a perspective view of a triangular rib or gusset plate used in forming the chisel or bevel bottom of the trench box panel and perforated to permit cavity to cavity communication for foaming in situ.

FIG. 9 shows the triangular bevel edge plates 23 with the opening 38 which allows the fillers 36 to be foamed in situ along the entire bottom 14 where designated. The form of the plate 23 establishes the degree of bevel and rigidizes and strengthens the bottom 14. The plate 23 is welded to the horizontal element 22 at spaced intervals and the vertical edge surface 39 contacts skin 12 and is welded thereto while the diagonal edge 40 contacts, is welded to and supports the transverse wall portion 37 (FIG. 6).

Figure 10:
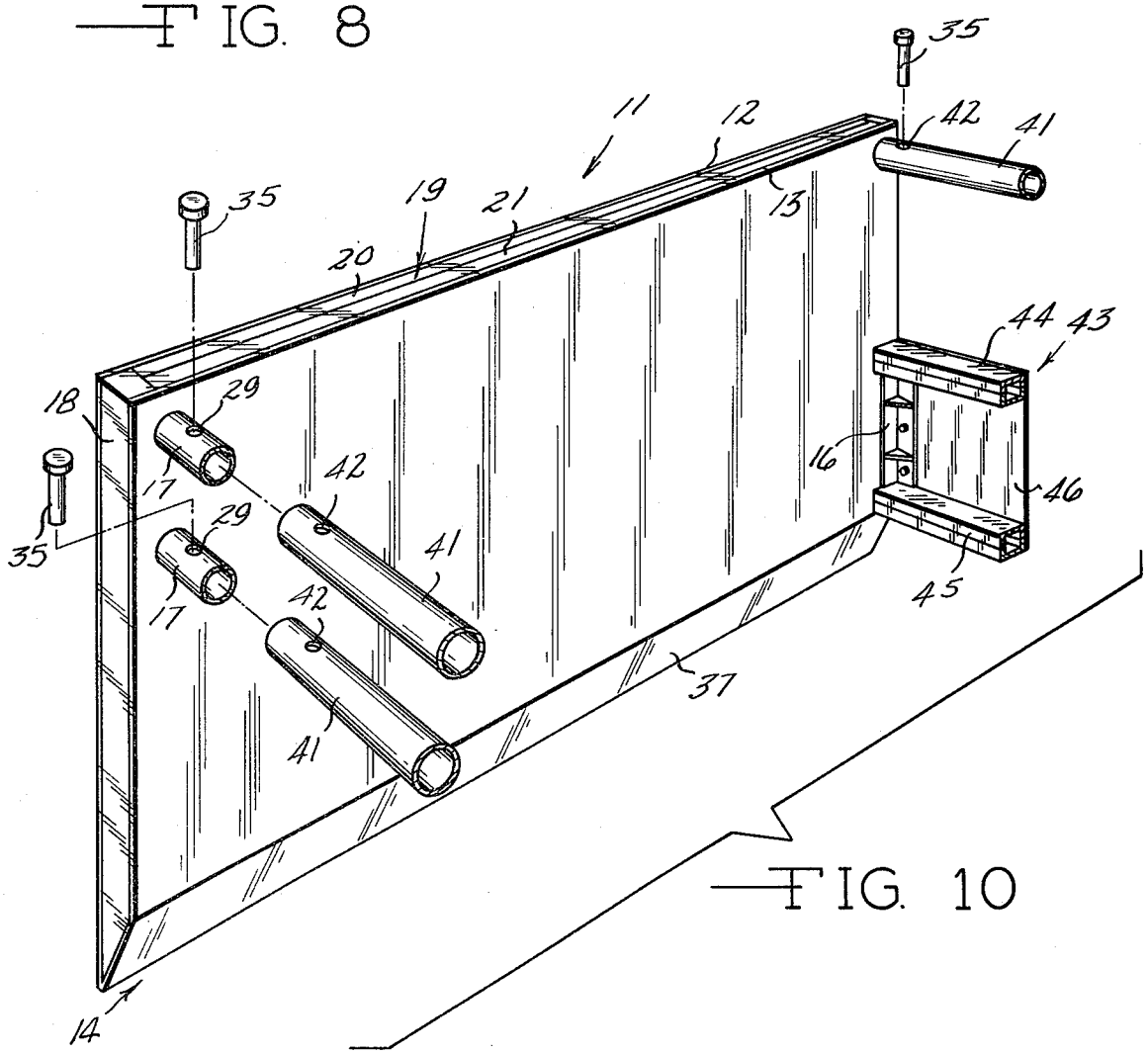
FIG. 10 is a partial exploded perspective view of a panel in accord with the present invention but with the second juxtapositioned panel removed for clarity and revealing the trench box spacers, the front plate and connectors and indicating the manner of assembly and disassembly in trench boxes.

In FIG. 10 one panel 11 is shown in its assembly and use relationship. The connection to a juxtaposed panel (not shown), similarly constructed, is by means of the tubular cylindrical spreaders 41, each end having openings 42 which register with the openings 29 in the collars 17 so that assembly pins 35 can be inserted when the spreaders 14 are run telescopically over the collars 17. A rectangular gate-like spacer or front panel 43 is attached as by bolts 49 to the brackets 16 provided at one end of the panels 11. The gate-like spacer 43 includes upper and lower structural stringers 44 and 45, respectively, and shown as paired channels welded at the flange contacts to form box section elements. These are fastened to a cover or front plate 46. As will be understood, another panel 11, oppositely oriented, is attached similarly to the spreaders 41 and gate spacer 43 to form a stable trench box. Where desired, plural panels 11 may be placed in stacked relation for trenches having a depth exceeding the height of individual of the panels 11.

Three definite processes are useful in making the panels 11. Firstly, the panel 11 is fully prepared with a skin 12 or 13 left open for access to the cavities. Then the filler blocks 28 are cut and placed snugly in the cavities. Then the box panel 11 is closed by welding or fastening the skin 12 or 13 in final position. Seam welding or fillet welding at the perimeters and projection or slot welding through the skin and into the broad interfaces of the skeletal frame. Secondly, by positioning the panel open on the one side, the cavities may be filled with plastic foaming composition and then cured in situ to fill level with the thickness of the cavities. Then the panel is closed by attaching the skin. Thirdly, the fillers 28 may be foamed in situ after the panel 11 is closed by providing openings into the cavities and using communicating passages as 38 and 32 to circulate the foaming composition into all internal cavities in an amount so that, upon curing, the lightweight foam fills the panel 11. Finally, the curing in situ and the panel 11 is completed.

In operation the advantages of the panels 11 where the cavities or voids are filled with water impermeable low weight plastic foam is that (a) rigid inspection for minor leakage is made less critical; (b) rips and tears of the skins in rugged usage does not result in the intrusion of water, mud and debris; and (c) the boxes do not become debris-logged after extensive usage and retain a manageable total weight in a relatively constant range. While a specific embodiment has been described and methods for practicing the invention, the invention will be appreciated as applicable to all shoring or trench box panels having spaced-apart outer walls and internal cavities which can be filled with low cost, low density, closed cell foamed plastic material.

Where welding is required after the insertion of the foamed filler, the broad flanges and interfaces between structural inner elements and the outer skin surfaces allow for good, wide welding surfaces spaced far enough away from the foamed plastic that the structurals act as a heat sink generally protecting damage to the foamed filler by the welding heats.

Having thus described the invention, others skilled in the art will perceive changes, improvements and modifications therein and such changes, improvements and modifications are intended to be included within the spirit of the present invention, limited only by the hereinafter appended claims.

I claim:

1. A trench box having water impermeable panels and each of said panels comprising:

a perimeter frame;

a plurality of vertical and horizontal internal support structural elements;

a pair of metal skin surfaces having plural connectors transversely extending from one side of said skin surfaces and secured to said skin surfaces and to selected of said structural elements, said skin surfaces registering on said frame and closing against and secured to said vertical and horizontal support structural elements;

a lightweight water impermeable closed cell foam filler in the cavities between said frame, said vertical and horizontal elements and said skins; and means separating pairs of said panels in spaced apart relation, said means attached to said connectors at the ends thereof.

2. The water impermeable trench box of claim 1 wherein said closed cell foamed plastic has a density of about two pounds per cubic foot and is a styrene plastic.

3. A trench box having water impermeable panels and each of said panels comprising:

a metal perimeter frame;

a plurality of vertical and horizontal structural elements connected to the perimeter frame and interconnected with each other in the volume defined by said frame;

a pair of metal skin surfaces registrably against said frame on both sides thereof and secured thereto and bearing against and secured to said vertical and horizontal structural elements;

a bevel edged bottom beneath and connected to said frame and closed against said skins;

a plurality of connector elements extending transversely outwardly from one of said metal skins and supported by said skins and by said structural elements; and a lightweight water impermeable closed cell foam in the cavities defined between said structural elements, said skins, said frame and in said bevel edged bottom.

4. In the process for manufacture of a water impermeable trench box having spaced apart connected water impermeable panels, said panels including a pair of spaced apart outer skins, inner structural members and connector means, the step of:

incorporating a plastic foamed low density closed cell filler in cavities of a trench box and between (a) each pair of spaced apart skins so as to substantially fill all cavities between structural members and said skins.

5. In the process of claim 4 wherein said filler is formed as by cutting and fitting into the open cavities of the panel prior to closing the panel and thereafter closing said panel by attachment of one of the skins of said panel.

6. In the process of claim 4 wherein said filler is formed within said cavities as by foaming said plastic in situ and thereafter closing said trench box panel.

7. A process for manufacture of a water impermeable trench box having spaced apart connected water impermeable panels said panels including a pair of spaced apart outer skins, inner structural members and connector means comprising the steps of:

opening selected holes into the cavities of each trench box panel;

injecting a filler or closed cell foam plastic composition into said openings until said cavities have received a quantity of composition to fill said cavities upon curing; and curing said filler in situ until expansion of said composition results in a complete filling of the cavities with a low weight unfilled plastic semi-rigid styrene plastic.

8. In the process of claim 7 wherein the plastic composition is a foam composition including styrene lastic.

* * * * *

UNITED STATES PATENT OFFICE

CERTIFICATE OF CORRECTION

Patent No. 4,259,028 Dated 1981 March 31

Inventor(s) John B. Cook

It is certified that error appears in the above-identified patent and that said Letters Patent are hereby corrected as shown below:

Column 6, line 15, change "14" to read --- 41 each end having openings 42 which register with the openings 29 in the collars 17 so that assembly pins 35 can be inserted when the spreaders 41 ---

Column 8, line 43, Claim 8, change "lastic" to read --- plastic ---

Signed and Sealed this

*Twenty-third* Day of *March 1982*

[SEAL]

*Attest:*

GERALD J. MOSSINGHOFF

*Attesting Officer*

*Commissioner of Patents and Trademarks*